US005645256A

United States Patent [19]

Thomas, II

[11] Patent Number: 5,645,256

[45] Date of Patent: Jul. 8, 1997

[54] MOUNTABLE LATCHING CLAMP FOR INSTRUMENT STANDS

[76] Inventor: Richard G. Thomas, II, 219 W. Milling, Lancaster, Calif. 93534

[21] Appl. No.: 290,242

[22] Filed: Aug. 15, 1994

[51] Int. Cl.[6] ..... G10D 3/00

[52] U.S. Cl. ..... 248/222.11; 84/327; 248/224.7; 403/325; 411/522

[58] Field of Search ..... 248/682, 220.21, 248/222.11, 224.7, 231.91, 27.1, 221.12; 84/327, 453; 403/325, 327, 329; 411/522, 512, 351, 348

[56] References Cited

U.S. PATENT DOCUMENTS

| | | | |
|---|---|---|---|
| 3,664,224 | 5/1972 | Campagna, Jr. | 84/327 X |
| 3,750,227 | 8/1973 | Hayhurst et al. | 403/325 X |
| 3,765,633 | 10/1973 | Caudill | 84/327 X |
| 4,029,038 | 6/1977 | Pfahl | 248/221.3 X |
| 4,042,201 | 8/1977 | O'Callaghan | 248/300 X |
| 4,097,485 | 6/1978 | O'Callaghan | 248/221.3 |
| 4,546,688 | 10/1985 | Cuccio | 84/327 |
| 4,991,809 | 2/1991 | Harkey | 84/327 X |
| 5,031,868 | 7/1991 | Thomas . | |
| 5,039,181 | 8/1991 | Lautenschlager | 248/298.1 X |
| 5,098,046 | 3/1992 | Webb | 248/27.1 |
| 5,313,866 | 5/1994 | Smith . | |
| 5,372,346 | 12/1994 | Upchurch et al. | 84/327 X |

FOREIGN PATENT DOCUMENTS

| | | | |
|---|---|---|---|
| 114834 | 5/1929 | Austria | 248/222.1 |

*Primary Examiner*—Derek J. Berger

*Attorney, Agent, or Firm*—Merchant, Gould, Smith, Edell, Welter & Schmidt

[57] ABSTRACT

A mountable latching clamp secures an instrument stand to a mountable structure. The clamp comprises an angle bracket, a keyed receiver connected to the angle bracket for coupling with the instrument stand, and a spring latch for securing the instrument stand in the keyed receiver.

15 Claims, 5 Drawing Sheets

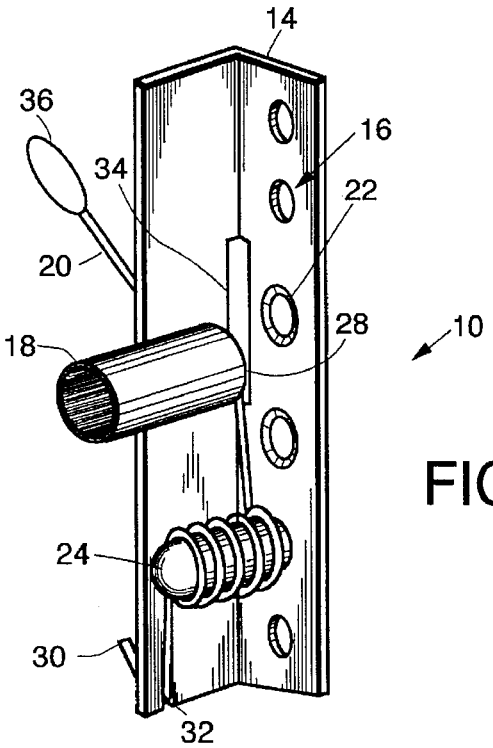
FIG. 1.
FIG. 2
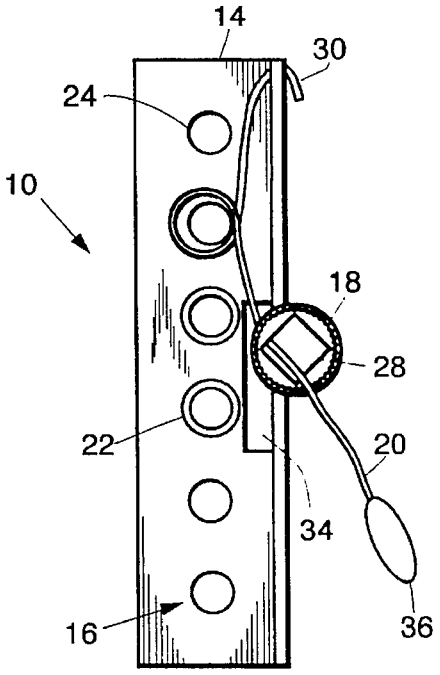
FIG. 3.
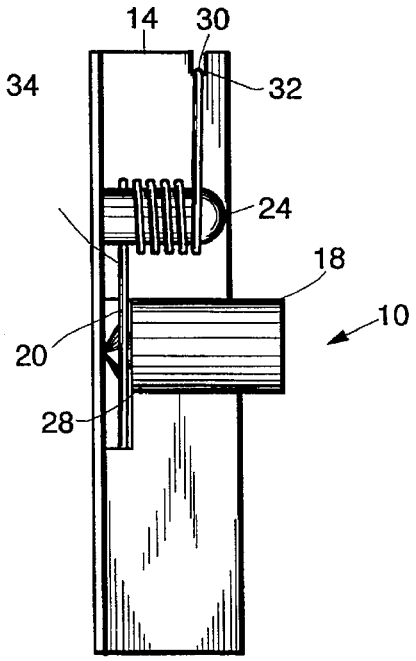

MOUNTABLE LATCHING CLAMP FOR INSTRUMENT STANDS

BACKGROUND OF THE INVENTION

1. Field of the Invention.

This invention relates in general to clamps, and in particular, to a mountable latching clamp for connecting instrument stands to rack systems, "combo amp" systems or walls, wherein the clamp has a keyed receiver for coupling with the instrument stands.

2. Description of Related Art

Musical entertainers utilize audio/video rack systems and/or combination amplifier speaker cabinet ("combo amp") systems. An audio/video rack system is a rectangularly shaped frame made of metal, plastic, or any other material suitable for holding heavy loads. Typically, the frame contains a plurality of holes or slots for securely arranging audio and video equipment within the rack system. Thus, audio and video equipment can be custom fitted within the rack system to suit any design for any particular occasion.

A "combo amp" system includes an adjustable amplifier with a speaker built into the amplifier. This allows the "combo amp" to be both convenient and portable. Thus, to accommodate portability, the "combo amp" system has a handle on the top side of the amplifier attached by at least two screws so that the system can be easily moved about.

Typically, both systems are used in the entertainment industry in both live and practice settings. Specifically, entertainers who use electric guitars or similar equipment need their systems nearby, because the systems contain the amplifiers necessary for performance. Therefore, it is very convenient for the entertainer to have their instruments on nearby support stands, such as the one disclosed in U.S. Pat. No. 5,031,868 and issued to the present applicant which is incorporated herein by reference, near the system being used.

However, such stands are usually either bolted directly to or placed unsecurely within the rack, "combo amp" or wall in an unstable and inconvenient manner. What is needed is a device that allows instrument stands to be quickly and conveniently fastened and unfastened to a rack system, "combo amp" system, wall or other mountable structure while maintaining secure attachment when fastened.

SUMMARY OF THE INVENTION

To overcome the limitations and the prior art described above, and to overcome other limitations that would become apparent upon reading and understanding the present specification, the present invention discloses a mountable latching clamp for an instrument stand. The clamp comprises an angle bracket, a keyed receiver connected to the angle bracket for coupling with the instrument stand, and a spring latch for securing the instrument stand in the keyed receiver. The angle bracket further comprises one or more mounting holes, so that it can be attached to a mountable structure using bolts, screws or the like. The keyed receiver has a multi-sided interior to prevent the instrument stand from rotating when inserted therein, and includes a square aperture so that the instrument stand extends only partially therethrough. The spring latch is coiled about a collar attached to the angle bracket and terminates in a J-hook that is secured in a notch in the angle bracket. The spring coupler is bent or otherwise configured to intersect an axis of the keyed receiver, so as to engage a connector bar of the instrument stand that is inserted through the keyed receiver.

The connector bar has an external shape configured to engage the interior of the keyed receiver to prevent it from rotating when inserted therein. The connector bar terminates in a tip and groove configuration that extends through a square aperture in the keyed receiver to engage the spring latch. The square aperture allows only the tip and groove of the connector bar to extend through the keyed receiver. The spring latch actively engages the groove of the connector bar so as to secure it in the keyed receiver. Further, an optional adaptor plate may be included for mounting the stand to the additional objects.

An object of the present invention is to provide a means for directly connecting instrument stands to rack, "combo amp" system, a wall, or any other mountable structure. A feature of the present invention is that the clamp is adaptable for virtually any mountable structure that allows attachment through connecting holes. Also, an advantage of the present invention is that the instrument stand can be quickly attached to and detached from the mountable structure at will.

The foregoing and still further features and advantages of the present invention, as well as a more complete understanding thereof, will be made apparent from a study of the following detailed description of the invention in connection with the accompanying drawing and appended claims.

BRIEF DESCRIPTION OF THE DRAWINGS

Referring now to the drawings in which like reference numbers represent corresponding parts throughout:

FIG. 1 illustrates a perspective view of the mountable latching clamp of the present invention;

FIG. 2 illustrates a front view of the mountable latching clamp of the present invention;

FIG. 3 illustrates a side view of the mountable latching clamp of the present invention;

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 4:
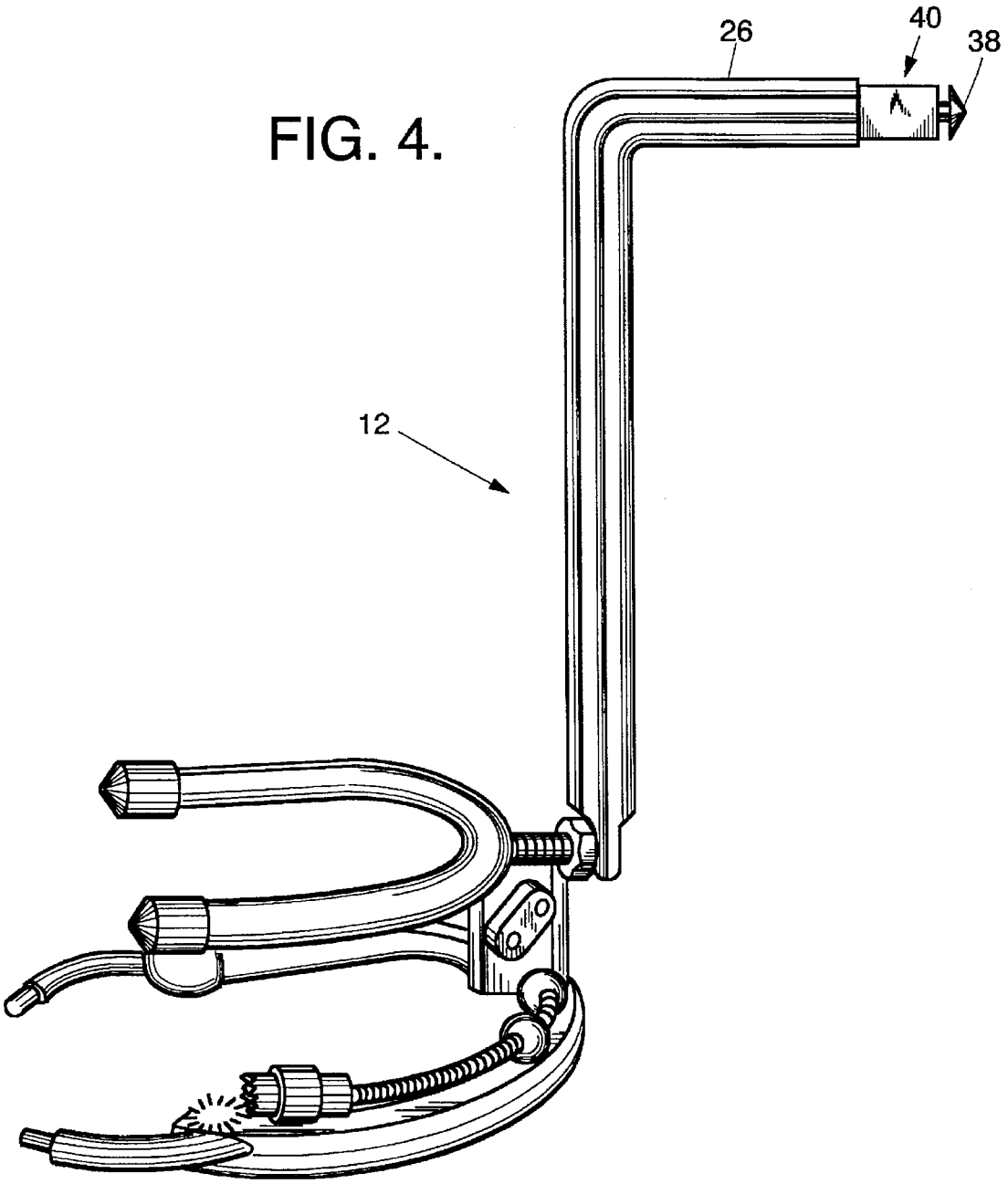
FIG. 4 illustrates a perspective view of the instrument stand and instrument connector bar of the present invention.
Figure 5:
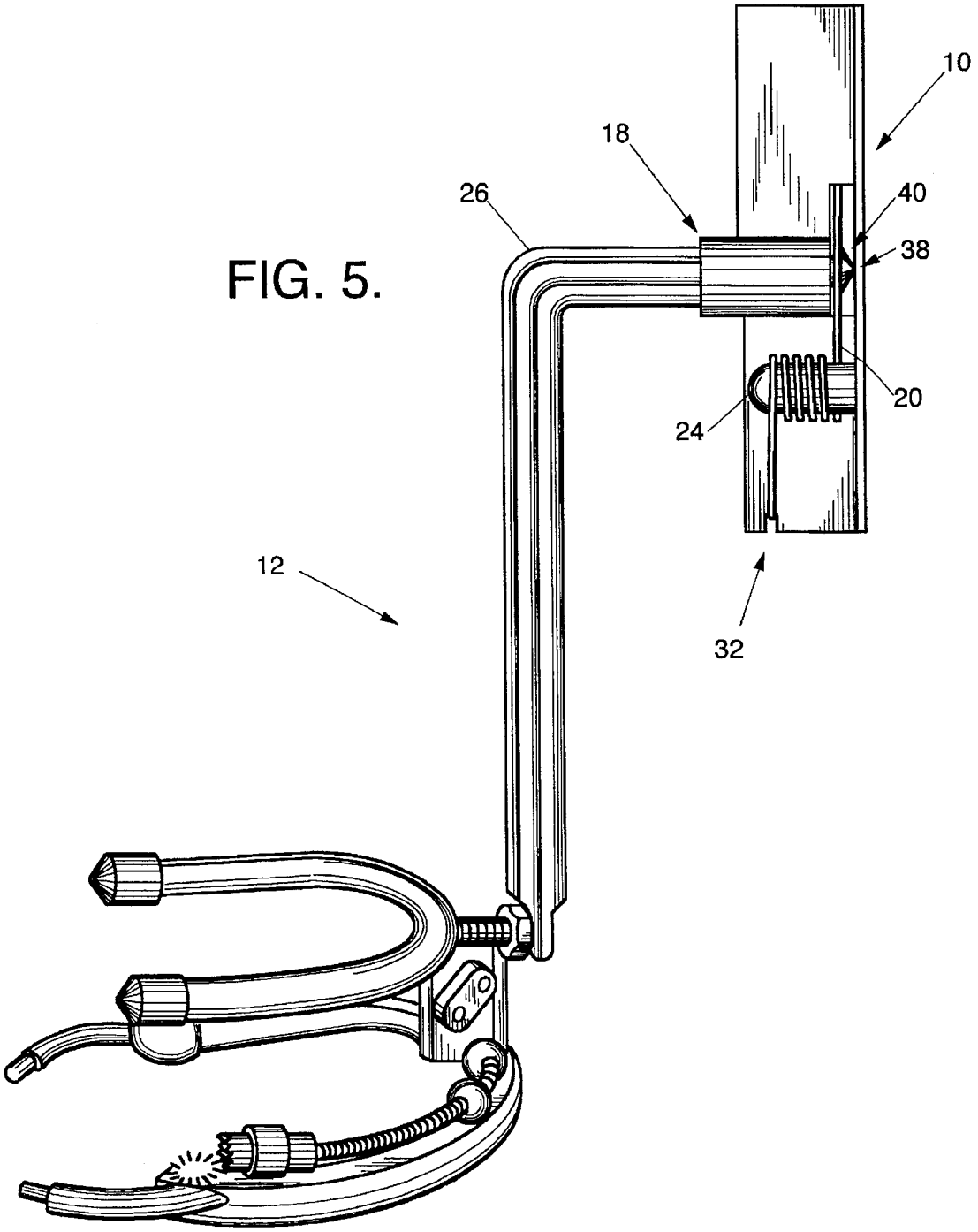
FIG. 5 illustrates a side view of the mountable latching clamp of the present invention coupled to a connector bar of the instrument stand.

FIG. 1 illustrates a perspective view of the mountable latching clamp 10 of the present invention, FIG. 2 illustrates a front view of the mountable latching clamp 10, FIG. 3 illustrates a side view of the mountable latching clamp 10, FIG. 4 illustrates a perspective view of an instrument stand 12, and FIG. 5 illustrates a side view of the mountable latching clamp 10 coupled to the instrument stand 12.

The mountable latching clamp 10 is comprised of an angle bracket 14 having several types of mounting holes 16, a keyed receiver 18 for coupling with the instrument stand 12, and a spring latch 20 for securing the instrument stand 12 in the keyed receiver 18. The angle bracket 14 is preferably metal or other similar material, and includes the keyed receiver 18 as an integral part thereof, either by welding the keyed receiver 18 to the bracket 14 or by forming a single piece unit comprised of both the bracket 14 and the keyed receiver 18 using some other method. The mounting holes 16 may comprise simple holes 16, beveled holes 22, or collared holes 24, and those skilled in the art will recognize that any number and combination of holes 16 could be used with the present invention.

The keyed receiver 18 has a multi-sided or grooved interior to prevent the connecter bar 26 of the instrument stand 12, which has a similar multi-sided exterior, from rotating when inserted therein. FIG. 2 illustrates that one end of the keyed receiver 18 has a square aperture 28 so that the connecter bar 26 only partially extends through the keyed receiver 18. FIG. 5 shows the connector bar 26 inserted into the keyed receiver 18.

The spring latch 20 is preferably coiled about the collared hole 24 and terminates in a J-hook 30 that is secured in a notch 32 in the angle bracket 14. The spring latch 20 also extends through a slit 34 in the angle bracket 14 and is configured to intersect the axis of the keyed receiver 18 as shown in FIG. 2. Preferably, the spring latch 20 includes a protective cap 36 on the end.

In operation, the connector bar 26 of the instrument stand 12 is inserted through the keyed receiver 18. The external shape of the connector bar 26 is configured to engage the interior of the keyed receiver 18 to prevent the connector bar 26 from rotating when inserted in the keyed receiver 18. The connector bar 26 terminates in a tip 38 and groove 40 configuration, wherein the tip 38 and groove 40 extend through the keyed receiver 18 to engage the spring latch 20. However, the square aperture 28 of the keyed receiver 18 allows only the tip 38 and groove 40 of the connector bar 26 to extend through the keyed receiver 18. The spring latch 20 in its resting position actively engages the groove 40 of the connector bar 26 so as to secure it in the keyed receiver 18. To remove the connector bar 26, the spring latch 20 is depressed to disengage it from the groove 40.

Figure 6:
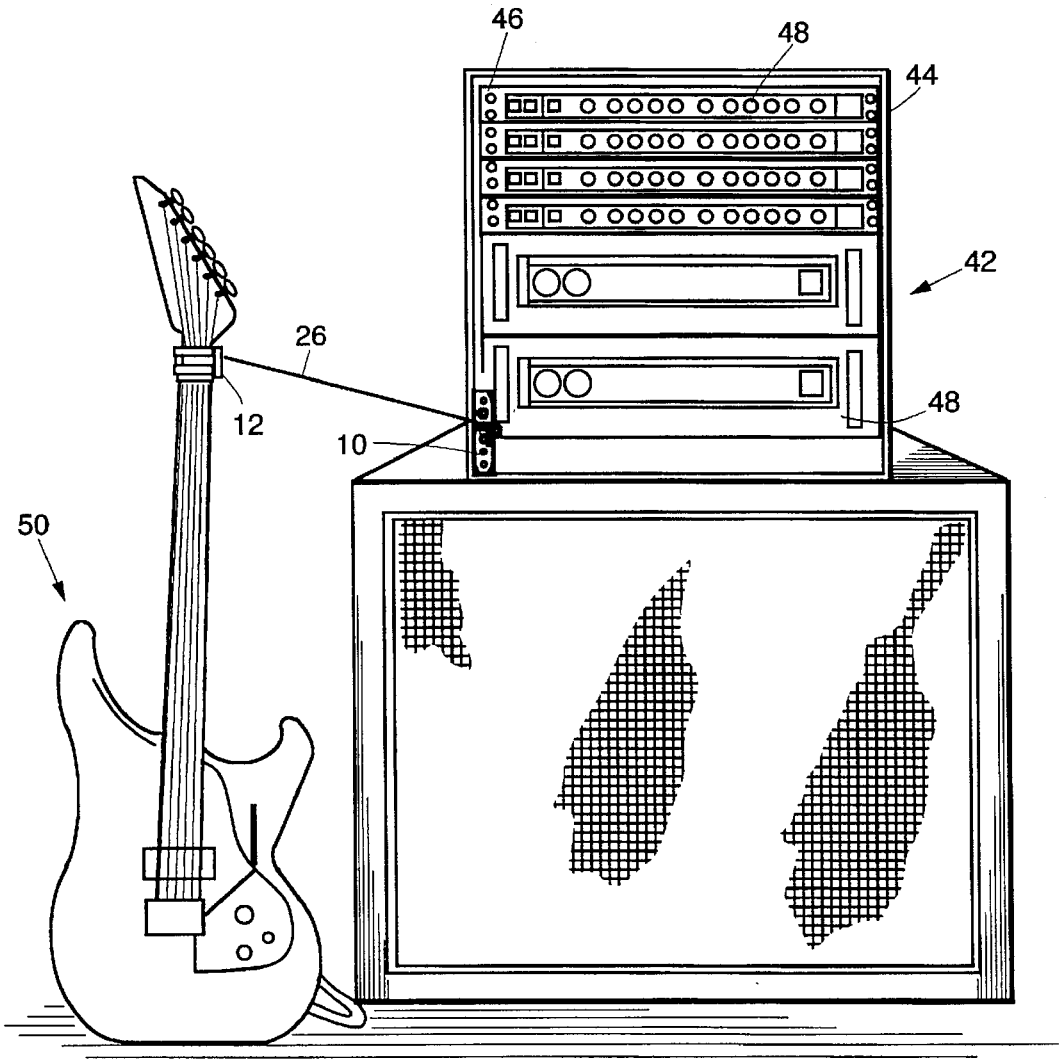
FIG. 6 illustrates a perspective view of the mountable latching clamp of the present invention coupled to a rack system.

FIG. 6 illustrates a perspective view of the mountable latching clamp of the present invention coupled to a rack system. The rack system 42 is a rectangularly shaped frame 44 made of metal, plastic, or any other material suitable for holding heavy loads. The frame 44 contains a plurality of holes or slots 46 for securely arranging audio and video equipment 48 within the rack system 42. A guitar 50 held by the instrument stand 12 and connector bar 26 can be coupled to the rack system 42. The connector bar 26 is connected to the mountable latching clamp 10 as described above. In addition, the mountable latching clamp 10 is connected to the rack system 42 through the holes or slots 46 via the mounting holes 16, beveled holes 22, or collared holes 24 of the mountable latching clamp 10 (shown in FIGS. 1–3). Thus, the guitar 50 can be fastened and unfastened to the rack system 42 quickly and conveniently while maintaining secure attachment when fastened.

Figure 7:
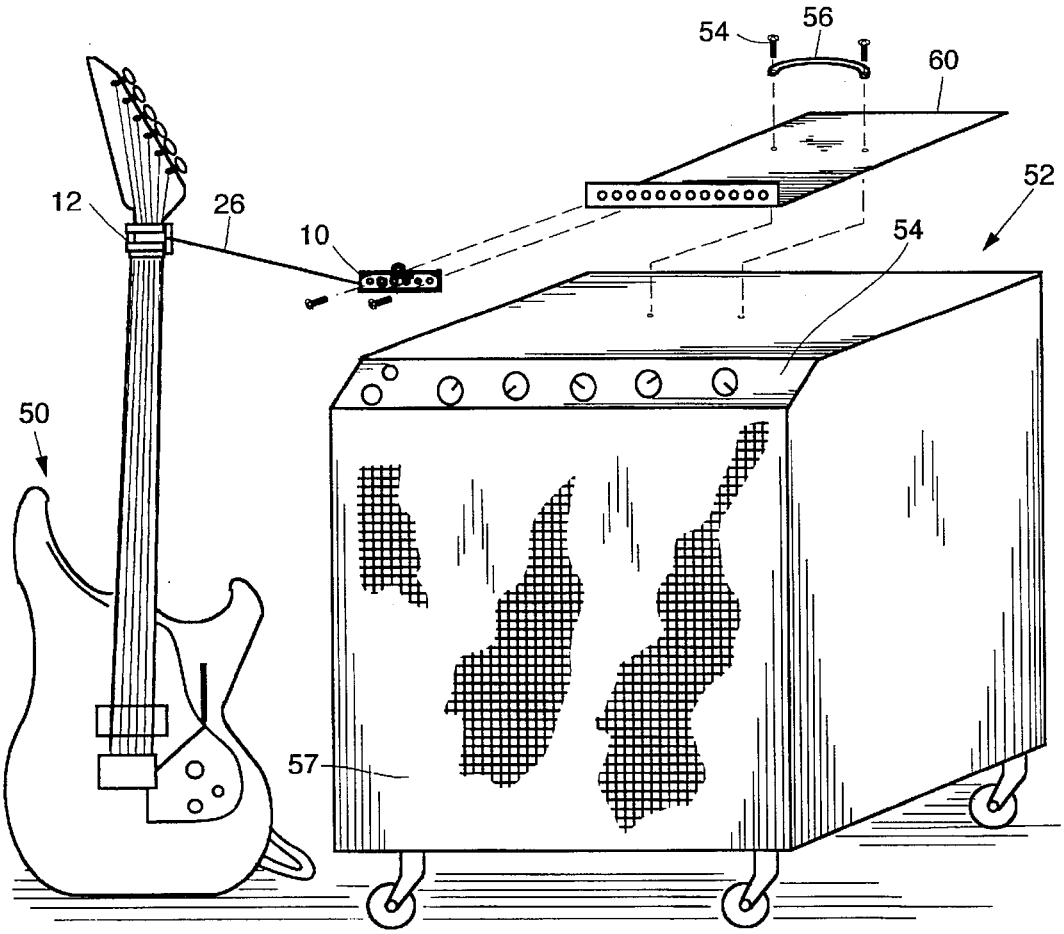
FIG. 7 illustrates an exploded view of the mountable latching clamp with an optional adaptor plate coupled to a "combo amp" system.

FIG. 7 illustrates an exploded view of the mountable latching clamp with an optional adaptor plate coupled to a "combo amp" system. The "combo amp" system 52 includes an adjustable amplifier 54 with a speaker 56 built into the amplifier 54. To accommodate portability, the "combo amp" system 52 has a handle 56 on the top side 58 of the amplifier attached by at least two screws 59 to allow portable movement of the system 52. The mountable latching clamp 10 is coupled to the "combo amp" system 52 via an adaptor plate 60. The adaptor plate 60 is installed between the handle 56 and the top side 58 of the "combo amp" system 52. The screws 59 secure both the handle 56 and the adaptor plate to the "combo amp" system 52. Thus, the instrument stand 12 and the connector bar 26 are connected to the mountable latching clamp 10 (shown in FIG. 5) so that the guitar 50 can be fastened and unfastened to the "combo amp" system 52 quickly and conveniently while maintaining secure attachment when fastened.

The ability to connect the guitar 50 to the rack system 42 or "combo amp" system 52 quickly and conveniently is important because both the rack system 42 and "combo amp" system 52 are used in the entertainment industry in both live and practice settings. Specifically, entertainers who use electric guitars 50 or similar equipment need their systems 42 or 52 nearby, because the systems 42 or 52 contain the amplifiers necessary for performance. Therefore, it is very convenient for the entertainer to have their instruments support stands 12 near the system 42 or 52 being used.

This concludes the description of the preferred embodiment of the invention. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by the detailed description, but rather by the claims appended hereto.

What is claimed is:

1. A mounting clamp for an instrument stand, comprising:

(a) a bracket;

(b) an instrument stand;

(c) receiver means, connected to the bracket, for coupling with the instrument stand, wherein the receiver means comprises a keyed receiver having a multi-sided interior to prevent the instrument stand from rotating when inserted therein to a fully inserted position; and (d) a latch for securing the instrument stand in the receiver means, wherein the latch comprises a spring coiled about a collar attached to the bracket.

2. The invention as set forth in claim 1 above, wherein the bracket is metal.

3. The invention as set forth in claim 1 above, wherein the bracket and the receiver means are welded together.

4. The invention as set forth in claim 1 above, wherein the bracket and the receiver means are molded as a single unitary piece.

5. The invention as set forth in claim 1 above, wherein the bracket further comprises one or more mounting holes and the clamp further comprises attachment means, inserted through the holes in the bracket, for securing the clamp to a mountable structure.

6. The invention as set forth in claim 5 above, wherein the mounting holes comprise beveled holes.

7. The invention as set forth in claim 5 above, wherein the mounting holes comprise collared holes.

8. The invention as set forth in claim 1 above, wherein the receiver means comprises an aperture that allows the instrument stand to extend only partially therethrough.

9. The invention as set forth in claim 1 above, wherein the latch comprises a spring that terminates in a J-hook that is secured in a notch in the bracket.

10. The invention as set forth in claim 1 above, wherein the latch is configured to intersect an axis of the receiver means.

11. The invention as set forth in claim 1 above, wherein the instrument stand includes a connector bar that is inserted through the receiver means.

12. The invention as set forth in claim 11 above, wherein the connector bar has an external shape configured to engage the interior of the receiver means to prevent the connector bar from rotating when inserted therein.

13. The invention as set forth in claim 11 above, wherein the connector bar terminates in a tip and groove configuration, and the tip and groove extend through the receiver means to engage the latch.

14. The invention as set forth in claim 13 above, wherein the receiver means further comprises means for allowing only the tip and groove of the connector bar to extend therethrough.

15. The invention as set forth in claim 13 above, wherein the latch actively engages the groove of the connector bar so as to secure it in the receiver means.

* * * * *